US008800833B2

(12) United States Patent
Fuwa

(10) Patent No.: US 8,800,833 B2
(45) Date of Patent: Aug. 12, 2014

(54) WEB MEANDERING CORRECTION SYSTEM AND WEB MEANDERING CORRECTION METHOD

(75) Inventor: Toshio Fuwa, Nisshin (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 950 days.

(21) Appl. No.: 12/935,981

(22) PCT Filed: Mar. 3, 2009

(86) PCT No.: PCT/IB2009/000407

§ 371 (c)(1),
(2), (4) Date: Oct. 1, 2010

(87) PCT Pub. No.: WO2009/125261

PCT Pub. Date: Oct. 15, 2009

(65) Prior Publication Data

US 2011/0024546 A1 Feb. 3, 2011

(30) Foreign Application Priority Data

Apr. 8, 2008 (JP) ..... 2008-100271

(51) Int. Cl.
*B65H 23/032* (2006.01)

(52) U.S. Cl.
USPC ..... 226/3; 226/15

(58) Field of Classification Search
USPC ..... 226/3, 11, 15; 250/559.36, 559.29, 250/559.01, 548
See application file for complete search history.

(56) References Cited

U.S. PATENT DOCUMENTS 3,437,823 A * 4/1969 Joyce ..... 250/559.18
3,557,351 A * 1/1971 Doering ..... 702/194

(Continued)

FOREIGN PATENT DOCUMENTS

| | | |
|---|---|---|
| JP | 9-208093 | 8/1997 |
| JP | 11-40144 | 2/1999 |
| JP | 2003-182896 | 7/2003 |
| JP | 2007-210747 | 8/2007 |

OTHER PUBLICATIONS

International Search Report in International Application No. PCT/IB2009/000407; Mailing Date: Jun. 18, 2009.

(Continued)

*Primary Examiner* — Sang Kim
*Assistant Examiner* — Scott Haugland
(74) *Attorney, Agent, or Firm* — Finnegan, Henderson, Farabow, Garrett & Dunner, LLP

(57) ABSTRACT

A web meandering correction system (1) includes: an edge detector (2) that detects an edge position signal of a web; an HPF processing unit (3) that executes a high-pass filtering process on the edge position signal using a predetermined lower limit frequency as a reference; a high-frequency noise analyzing unit (4) that analyzes high-frequency noise that has passed through the HPF processing unit (3); an LPF processing unit (5) that executes a low-pass filtering process on the edge position signal using a predetermined upper limit frequency as a reference; a coefficient setting unit (6) that sets a coefficient that determines the characteristics of the low-pass filtering process on the basis of a result of analysis by the high-frequency noise analyzing unit (4); and a meandering correction unit (7) that corrects meandering of the web on the basis of information acquired by the LPF processing unit (5).

7 Claims, 7 Drawing Sheets

(56) References Cited

U.S. PATENT DOCUMENTS

| | | | | | |
|---|---|---|---|---|---|
| 3,594,755 | A | * | 7/1971 | Pijls | 28/185 |
| 4,061,222 | A | * | 12/1977 | Rushing | 198/807 |
| 4,641,070 | A | | 2/1987 | Pfizenmaier et al. | |
| 4,746,020 | A | * | 5/1988 | Schenk | 209/3.3 |
| 4,875,769 | A | * | 10/1989 | Linebarger | 356/28 |
| 4,965,736 | A | * | 10/1990 | Balakrishnan | 700/129 |
| 5,107,780 | A | * | 4/1992 | Braun | 112/314 |
| 5,126,946 | A | | 6/1992 | Ko | |
| 5,467,194 | A | | 11/1995 | Pellinen et al. | |
| 5,873,392 | A | * | 2/1999 | Meyer et al. | 139/113 |
| 5,989,368 | A | * | 11/1999 | Tillander et al. | 156/64 |
| 6,289,729 | B1 | | 9/2001 | Haque et al. | |
| 2003/0116042 | A1 | * | 6/2003 | Ohba et al. | 101/225 |
| 2004/0149940 | A1 | | 8/2004 | Buisker et al. | |
| 2006/0028657 | A1 | * | 2/2006 | Typpo | 356/623 |

OTHER PUBLICATIONS

Written Opinion of the International Search Authority in International Application No. PCT/IB2009/000407; Mailing Date: Jun. 18, 2009.

* cited by examiner

WEB MEANDERING CORRECTION SYSTEM AND WEB MEANDERING CORRECTION METHOD

CROSS-REFERENCE TO RELATED APPLICATIONS

This application is a national phase application of International Application No. PCT/IB2009/000407, filed Mar. 3, 2009, and claims the priority of Japanese Application No. 2008-100271, filed Apr. 8, 2008, the contents of both of which are incorporated herein by reference.

BACKGROUND OF THE INVENTION

1. Field of the Invention

The invention relates to a technique for correcting meandering of a web, which is a sheet-like continuous material, in an apparatus that transports the web.

2. Description of the Related Art

An apparatus that transports a web, such as a metal film or a plastic film, while supporting the web with a plurality of rollers has been suggested. In the above apparatus, the web meanders due to various reasons. Therefore, there is a need for a technique for correcting or preventing the meandering of the web.

The following related arts are disclosed as techniques for handling the meandering of the web. Japanese Patent Application Publication No. 2007-210747 (JP-A-2007-210747) describes a technique that a filter is provided to extract a variation in level of a signal output from an edge sensor in edge detection of a recording medium in an ink jet printer, or the like. According to JP-A-2007-210747, this can remove a component of an unnecessary frequency band from the signal output from the edge sensor.

Japanese Patent Application Publication No. 2003-182896 (JP-A-2003-182896) describes a technique that a low-pass filter is provided to remove a high-frequency component from a signal output from a processing unit that processes a signal output from an edge position detection sensor.

Japanese Patent Application Publication No. 11-40144 (JP-A-11-40144) describes a technique that an electrode material before reaching a winding machine is pinched by a pair of rotatable rollers from both sides and then an edge of the electrode material is adjusted by rotating the rollers on the basis of a detected edge position.

Japanese Patent Application Publication No. 9-208093 (JP-A-9-208093) describes a technique that a feeding position of a widthwise edge of a belt-like element is adjusted by moving a position of a feeding-side shaft in a widthwise direction of the belt-like element on the basis of the widthwise displacement of the belt-like element and the moving speed of the belt-like element.

As described in JP-A-2007-210747 or JP-A-2003-182896, in web meandering correction control, it is necessary to remove a high-frequency component from a signal detected by an edge sensor. This is because the high-frequency component includes noise that is not caused by meandering of a web but by an initial shape of an edge of a web, or the like. When web meandering correction control is executed in a feedback manner, or the like, to track that noise, inconvenience, such as oscillation, may occur. On the other hand, when meandering correction control is intended with high accuracy, it is necessary to acquire a feedback gain as much as possible. Thus, it is desirable to acquire a detection signal having a frequency band as wide as possible. In order to implement this, it is effective that, in a low-pass filtering process executed on a signal detected by an edge sensor, an upper limit frequency used as a reference for cutting off is set to the highest frequency possible within the range that does not include the high-frequency noise.

However, the upper limit frequency in the low-pass filtering process is normally fixed. For this reason, for example, even when there is substantially no high-frequency noise, a signal detected by an edge sensor is handled in a similar manner. In terms of this point, there is still room for improvement to implement meandering correction control with high accuracy.

SUMMARY OF THE INVENTION

The invention provides a web meandering correction system and web meandering correction method that are able to reliably remove high-frequency noise and are also able to optimize a low-pass filtering process depending on the condition of the high-frequency noise in web meandering correction control.

A first aspect of the invention provides a web meandering correction system. The web meandering correction system includes: edge detecting means that detects an edge position signal that indicates the position of a widthwise edge of a web; HPF processing means that executes a high-pass filtering process on the edge position signal detected by the edge detecting means using a predetermined lower limit frequency as a reference; high-frequency noise analyzing means that analyzes high-frequency noise that has passed through the HPF processing means; LPF processing means that executes a low-pass filtering process on the edge position signal detected by the edge detecting means using a predetermined upper limit frequency as a reference; coefficient setting means that sets a coefficient that determines the characteristics of the low-pass filtering process, executed by the LPF processing means, on the basis of a result of analysis performed by the high-frequency noise analyzing means; and meandering correction means that executes a process for correcting meandering of the web on the basis of information acquired by the LPF processing means.

With the above configuration, the characteristics of the low-pass filtering process are determined on the basis of the result of analysis of the high-frequency noise acquired through the high-pass filtering process. Thus, in the web meandering correction control, it is possible to reliably remove high-frequency noise, and it is also possible to optimize the low-pass filtering process depending on the condition of high-frequency noise.

In addition, the high-frequency noise analyzing means may include noise variance calculating means that calculates a variance of the high-frequency noise.

By analyzing the variance of the high-frequency noise, it is possible to appropriately hold the state of the high-frequency noise.

In addition, the coefficient setting means may include upper limit frequency setting means that sets the upper limit frequency on the basis of the variance calculated by the noise variance calculating means.

By referring to the variance of the high-frequency noise, it is easy to set the upper limit frequency as high as possible within the range that does not include the high-frequency noise.

In addition, the upper limit frequency setting means may set the upper limit frequency such that the upper limit frequency is reduced as the variance increases and the upper limit frequency is increased as the variance reduces.

For the large variance, when the upper limit frequency is increased, the likelihood that the high-frequency noise is included increases. Thus, it is effective to set the upper limit frequency as in the above manner.

In addition, the web meandering correction system may further include abnormality detecting means that detects occurrence of an abnormality on the basis of the variance.

For example, when the variance exceeds a threshold, or when the duration of the state that the variance exceeds a threshold reaches a predetermined period of time, it is possible to determine that an abnormality has occurred in a web or a system. Thus, it is effective to utilize the variance for abnormality detection.

In addition, the abnormality detecting means may determine that an abnormality has occurred when the variance exceeds a predetermined upper limit value and when the duration of the state that the variance exceeds the predetermined upper limit value has reached a predetermined period of time. Furthermore, when the abnormality detecting means determines that an abnormality has occurred, the abnormality detecting means may record a log that indicates a state that the abnormality has occurred.

By so doing, it is possible to specify an abnormal location of a web, and it is also possible to recognize time at which an abnormality has occurred.

A second aspect of the invention provides a web meandering correction method. The web meandering correction method includes: detecting an edge position signal that indicates the position of a widthwise edge of a web; executing a high-pass filtering process on the edge position signal using a predetermined lower limit frequency as a reference; analyzing high-frequency noise that has passed through the high-pass filtering process; executing a low-pass filtering process on the edge position signal using a predetermined upper limit frequency as a reference; setting a coefficient that determines the characteristics of the low-pass filtering process on the basis of a result of analysis of the high-frequency noise; and correcting meandering of the web on the basis of information acquired through the low-pass filtering process.

In addition, the analysis of the high-frequency noise may include calculating a variance of the high-frequency noise.

In addition, the upper limit frequency may be set on the basis of the variance.

In addition, the upper limit frequency may be set so that the upper limit frequency is reduced as the variance increases and the upper limit frequency is increased as the variance reduces.

In addition, the web meandering correction method may further include detecting occurrence of an abnormality on the basis of the variance.

In addition, the detection of occurrence of an abnormality may include determining that an abnormality has occurred when the variance exceeds a predetermined upper limit value and when the duration of the state that the variance exceeds the predetermined upper limit value has reached a predetermined period of time, and recording a log that indicates the state.

The function and advantageous effects according to the web meandering correction method are similar to those of the web meandering correction system.

As described above, according to the aspects of the invention, it is possible to reliably remove high-frequency noise, and it is also possible to optimize a low-pass filtering process depending on the condition of the high-frequency noise in web meandering correction control.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Figure 1:
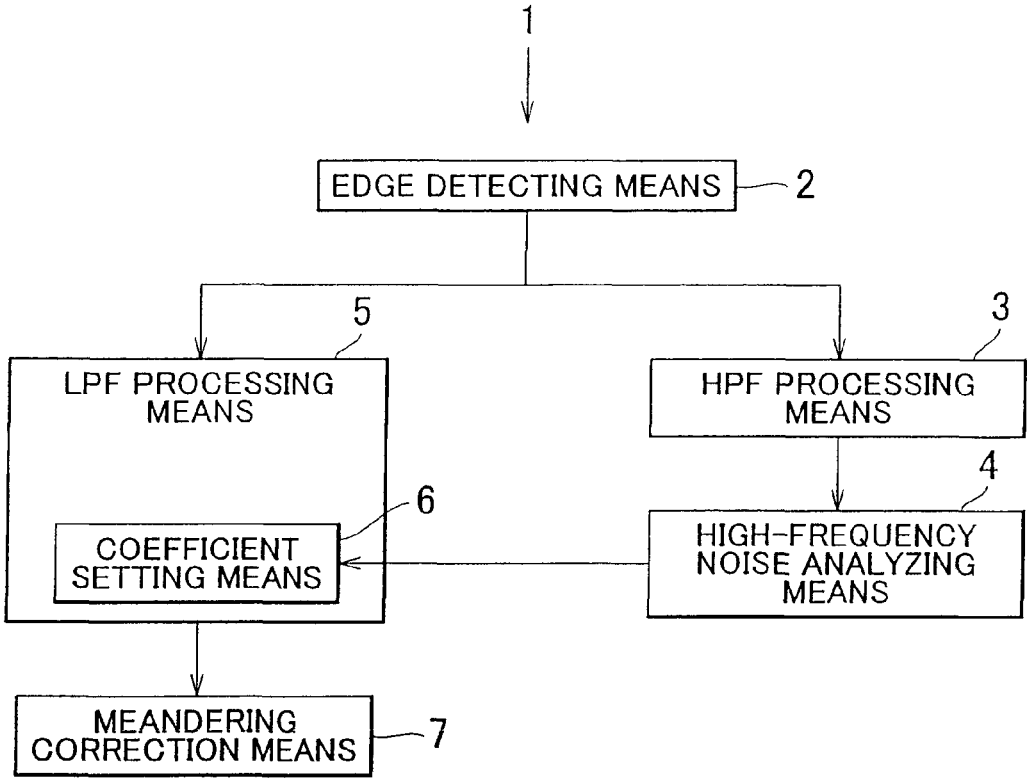
FIG. 1 is a view that shows the basic configuration of a web meandering correction system according to an embodiment of the invention.

Hereinafter, an embodiment of the invention will be described with reference to the accompanying drawings. FIG. 1 is a block diagram that shows the basic configuration of a web meandering correction system 1 according to an embodiment of the invention. The web meandering correction system 1 includes edge detecting means 2, HPF processing means 3, high-frequency noise analyzing means 4, LPF processing means 5, coefficient setting means 6, and meandering correction means 7.

The edge detecting means 2 detects an edge position signal that indicates the position of a widthwise edge of a web.

The HPF processing means 3 executes a high-pass filtering process on the edge position signal detected by the edge detecting means 2 using a predetermined lower limit frequency as a reference.

The high-frequency noise analyzing means 4 analyzes high-frequency noise that has passed through the HPF processing means 3.

The LPF processing means 5 executes a low-pass filtering process on the edge position signal detected by the edge detecting means 2 using a predetermined upper limit frequency as a reference.

The coefficient setting means 6 sets a coefficient that determines the characteristics of the low-pass filtering process, executed by the LPF processing means 5, on the basis of the result of analysis performed by the high-frequency noise analyzing means 4.

The meandering correction means 7 executes a process for correcting meandering of the web on the basis of information acquired by the LPF processing means 5.

As described above, in the present embodiment, the characteristics of the low-pass filtering process are determined on the basis of the result of analysis of the high-frequency noise acquired through the high-pass filtering process. This high-frequency noise includes noise that is not caused by meandering of a web but by an initial shape of an edge of a web, or the like, and should not be utilized as a feedback value, or the like, in meandering correction control. According to the present embodiment, in the web meandering correction control, it is possible to reliably remove high-frequency noise, and it is also possible to optimize the low-pass filtering process depending on the condition of the high-frequency noise.

Hereinafter, the embodiment of the invention will be described in more specific embodiments with reference to the accompanying drawings. Note that, in different embodiments, like reference numerals denote like components having the same or similar function and advantageous effects, and the description thereof will not be repeated.

First Embodiment

Figure 2:
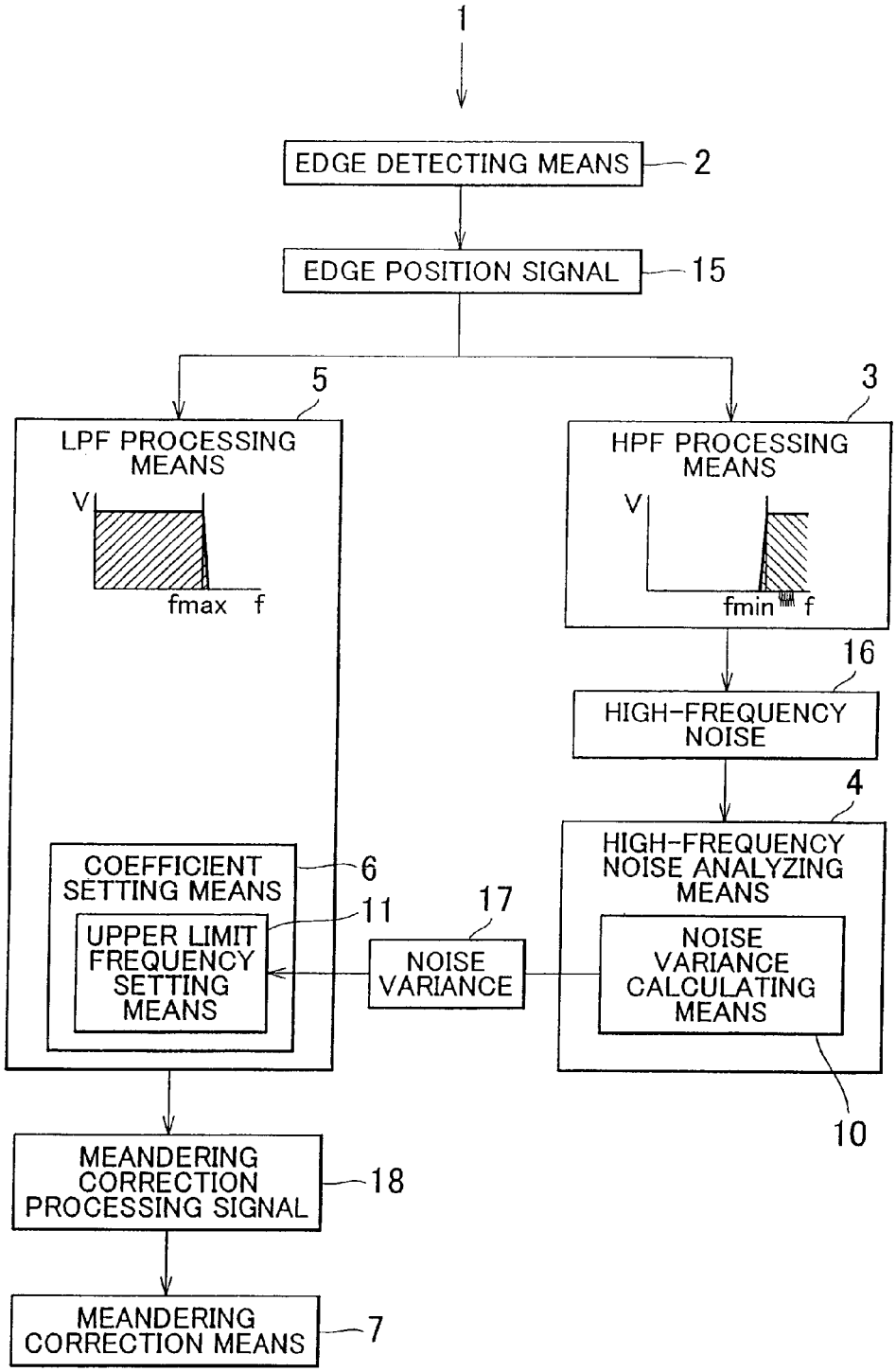
FIG. 2 is a view that shows the configuration of a web meandering correction system according to a first embodiment of the invention.

FIG. 2 shows the configuration of the web meandering correction system 1 according to the present embodiment. The edge detecting means 2 is a known sensor that detects the position of a widthwise edge of a web, and outputs information regarding the detected position of the edge to the HPF processing means 3 and the LPF processing means 5 as an edge position signal 15.

The HPF processing means 3 is a known device formed of a capacitor and a register. The HPF processing means 3 removes a frequency component lower than a predetermined lower limit frequency fmin. High-frequency noise 16 that has passed through the HPF processing means 3 is output to the high-frequency noise analyzing means 4.

The high-frequency noise analyzing means 4 is formed of a combination of a CPU, a storage device (ROM, RAM, or the like), an I/O port, a predetermined program, and the like. The high-frequency noise analyzing means 4 analyzes noise that is not caused by meandering of the web, that is, noise caused by an initial shape, or the like, of the edge of the web, on the basis of the high-frequency noise 16. In the present embodiment, the high-frequency noise analyzing means 4 includes noise variance calculating means 10.

The noise variance calculating means 10 calculates the variance of the high-frequency noise 16. The noise variance 17 calculated here is output to upper limit frequency setting means 11, which will be described later.

The LPF processing means 5 is a known device formed of a capacitor and a register. The LPF processing means 5 removes a frequency component higher than a predetermined upper limit frequency fmax. A signal that has passed through the LPF processing means 5 is output to the meandering correction means 7 as a meandering correction processing signal 18 that is used in the web meandering correction process.

The coefficient setting means 6 is formed of a combination of a CPU, a storage device, an I/O port, a predetermined program, and the like. The coefficient setting means 6 sets a coefficient that determines the characteristics of the low-pass filtering process, executed by the LPF processing means 5, on the basis of the result of analysis performed by the high-frequency noise analyzing means 4. In the present embodiment, the coefficient setting means 6 includes the upper limit frequency setting means 11.

The upper limit frequency setting means 11 sets the upper limit frequency fmax on the basis of the noise variance 17. This setting is performed on the basis of a characteristic curve L shown in FIG. 3. That is, the upper limit frequency fmax is reduced as the variance S of the high-frequency noise 16, calculated by the noise variance calculating means 10, increases, while the upper limit frequency fmax is increased as the variance S reduces.

Figure 4A:
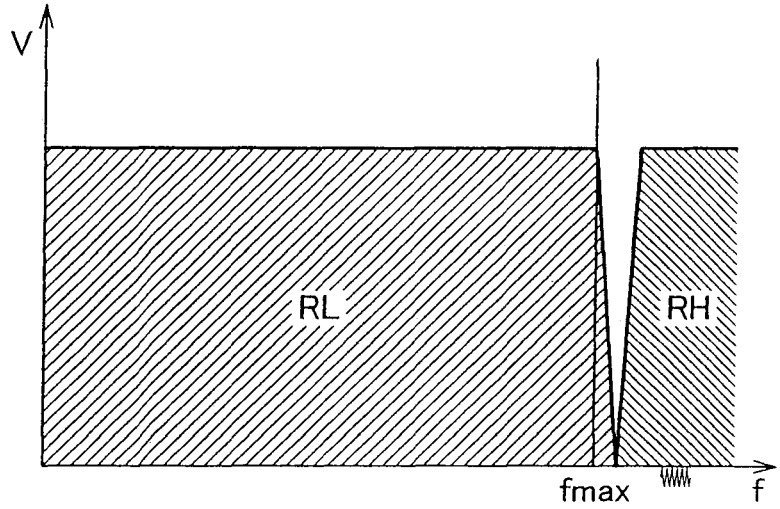
FIG. 4A is a view that shows setting of the upper limit frequency when the variance is relatively small.
Figure 4B:
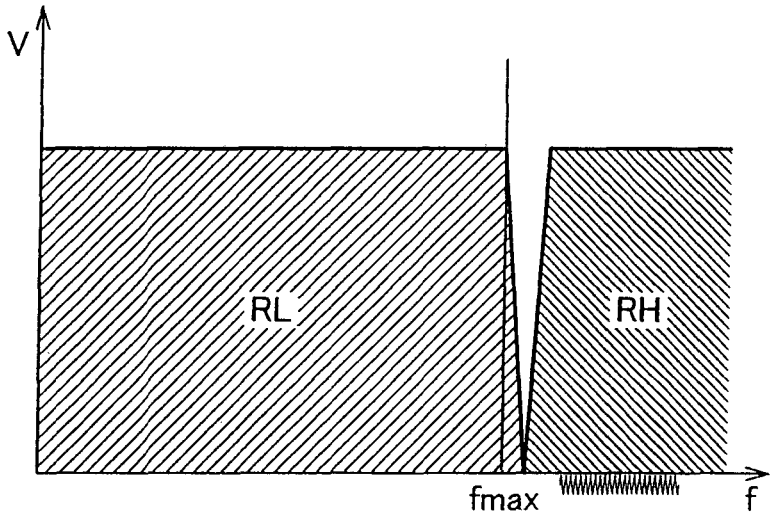
FIG. 4B is a view that shows setting of the upper limit frequency when the variance is relatively large.

The above described setting of the upper limit frequency fmax has features as shown in FIG. 4A and FIG. 4B. FIG. 4A and FIG. 4B each show a low-pass frequency range RL that passes through the low-pass filtering process and a high-pass frequency range RH that passes through the high-pass filtering process. A signal that falls within the low-pass frequency range RL is output to the meandering correction means 7 as the meandering correction processing signal 18. FIG. 4A shows an example when the variance S is relatively small. FIG. 4B shows an example when the variance S is relatively large. As shown in these examples, the upper limit frequency fmax is increased when the variance S is small, while the upper limit frequency fmax is reduced when the variance S is large. This is because, when the variance S is small, the likelihood that the high-frequency noise 16 is included within the low-pass frequency range RL is low, while when the variance S is large, the likelihood that the high-frequency noise 16 is included within the low-pass frequency range RL is high.

Figure 5:
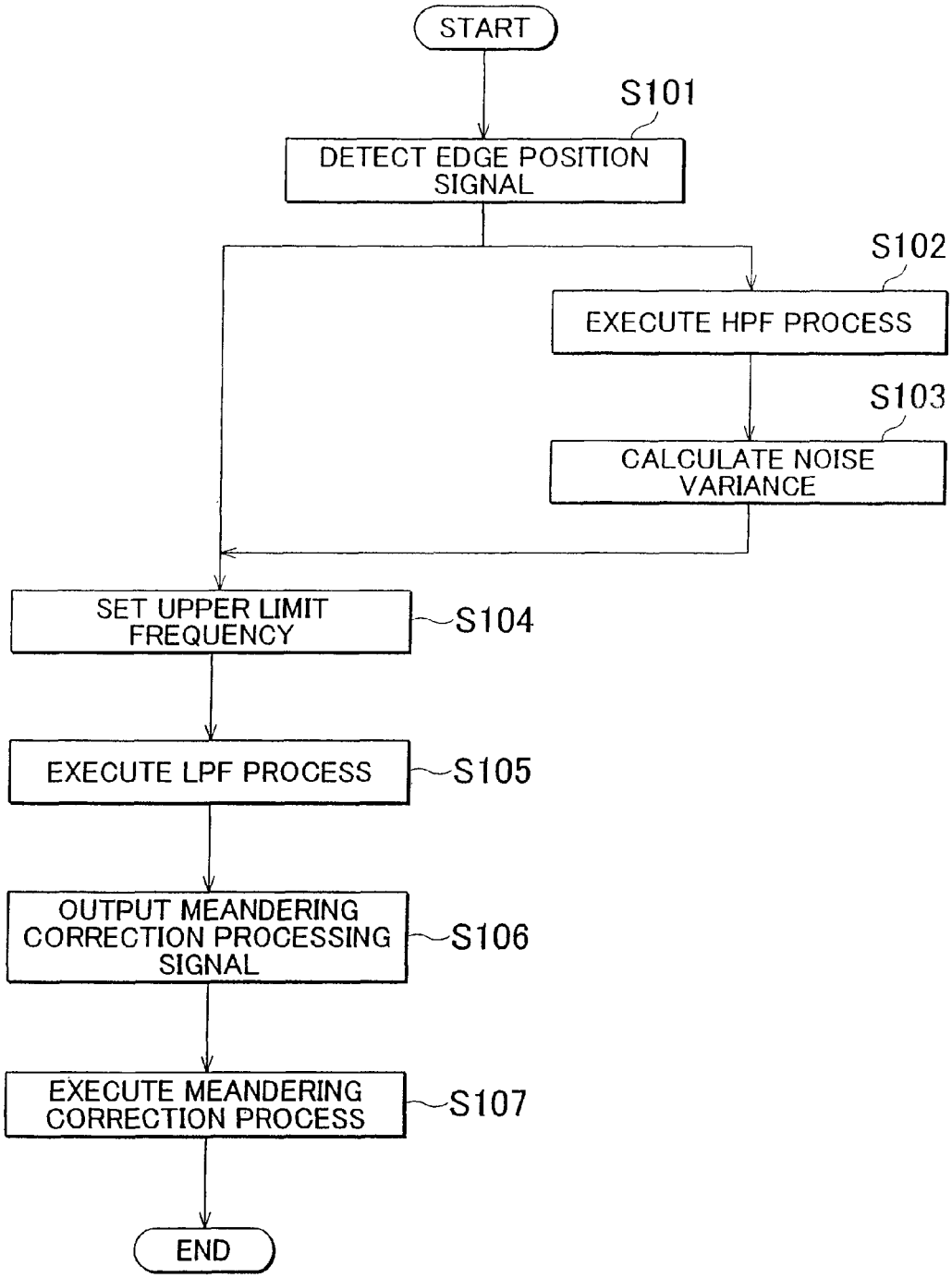
FIG. 5 is a flowchart that shows the process flow executed in the web meandering correction system according to the first embodiment of the invention.

FIG. 5 shows the process flow executed in the above configured web meandering correction system 1. In this process, when the edge detecting means 2 (see FIG. 2) detects the edge position signal 15 (S101), the HPF processing means 3 executes a high-pass filtering process on the edge position signal 15 (S102). Then, the variance of the high-frequency noise 16 acquired through the high-pass filtering process is calculated by the noise variance calculating means 10 (S103).

After that, the upper limit frequency setting means 11 sets the upper limit frequency fmax on the basis of the calculated noise variance 17 (S104), and then the LPF processing means 5 executes a low-pass filtering process on the edge position signal 15 on the basis of the upper limit frequency fmax (S105). The signal that has passed through the low-pass filtering process is output to the meandering correction means 7 as the meandering correction processing signal 18 (S106). The meandering correction means 7 executes a web meandering correction process on the basis of the meandering correction processing signal 18 (S107).

According to the web meandering correction system 1 of the present embodiment, in the control of correcting meandering of the web, it is possible to reliably remove the high-frequency noise 16 from the edge position signal 15, and it is also possible to optimize the low-pass filtering process so that an effective signal is constantly acquired in an optimal state.

Second Embodiment

Figure 6:
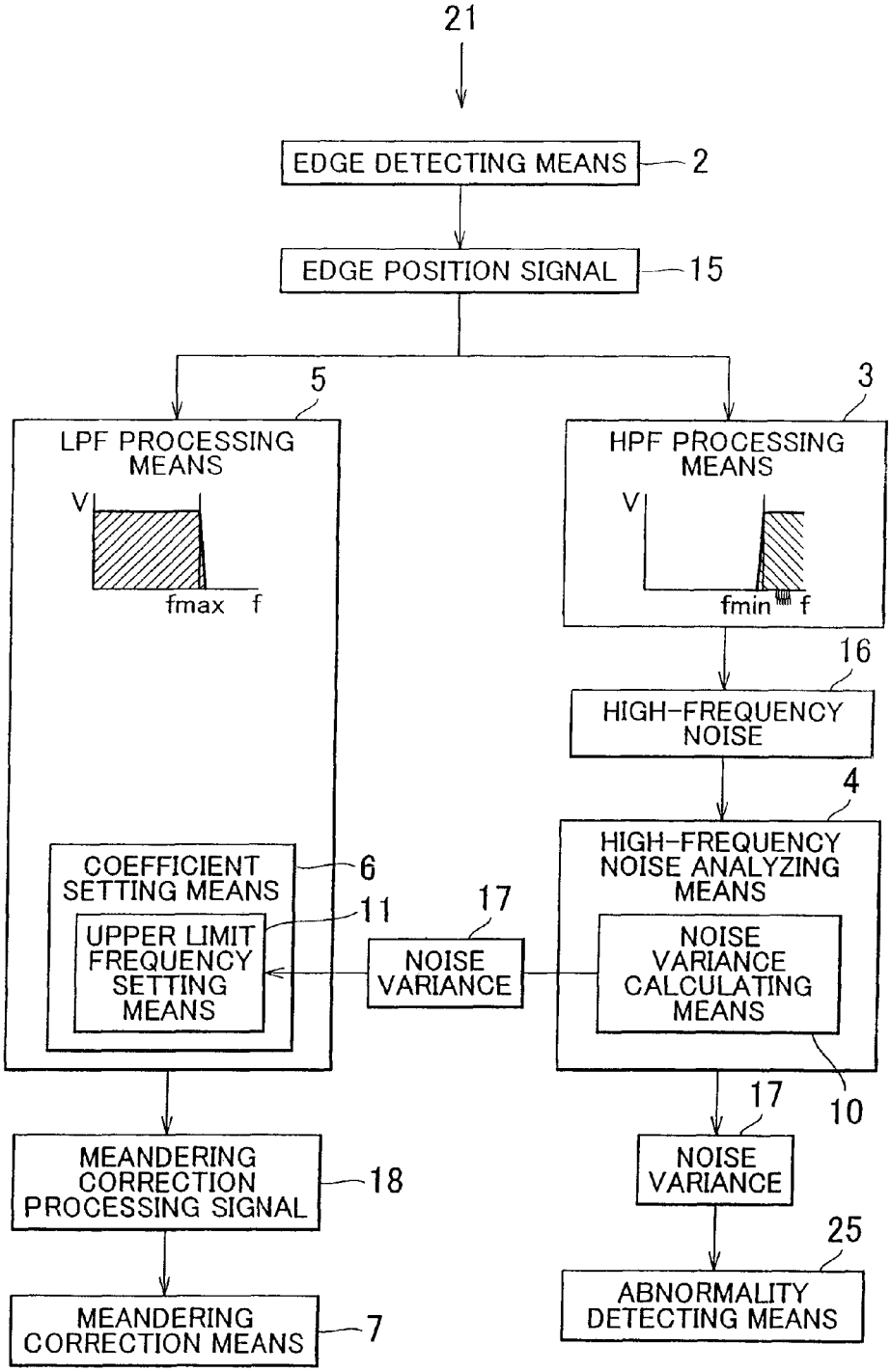
FIG. 6 is a view that shows the configuration of a web meandering correction system according to a second embodiment of the invention.

FIG. 6 shows the configuration of a web meandering correction system 21 according to the present embodiment. The web meandering correction system 21 differs from that of the first embodiment in that the web meandering correction system 21 includes abnormality detecting means 25.

The abnormality detecting means 25 detects occurrence of an abnormality on the basis of the noise variance 17 output from the noise variance calculating means 10. The abnormality detecting means 25 is formed of a combination of a CPU, a storage device, an I/O port, a predetermined program, and the like.

Figure 3:
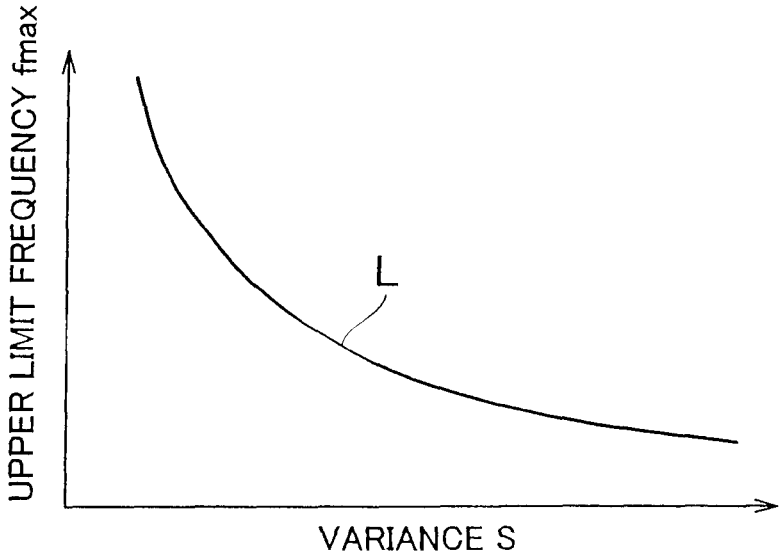
FIG. 3 is a view that shows the characteristic curve that determines the relationship between a variance and an upper limit frequency.
Figure 7:
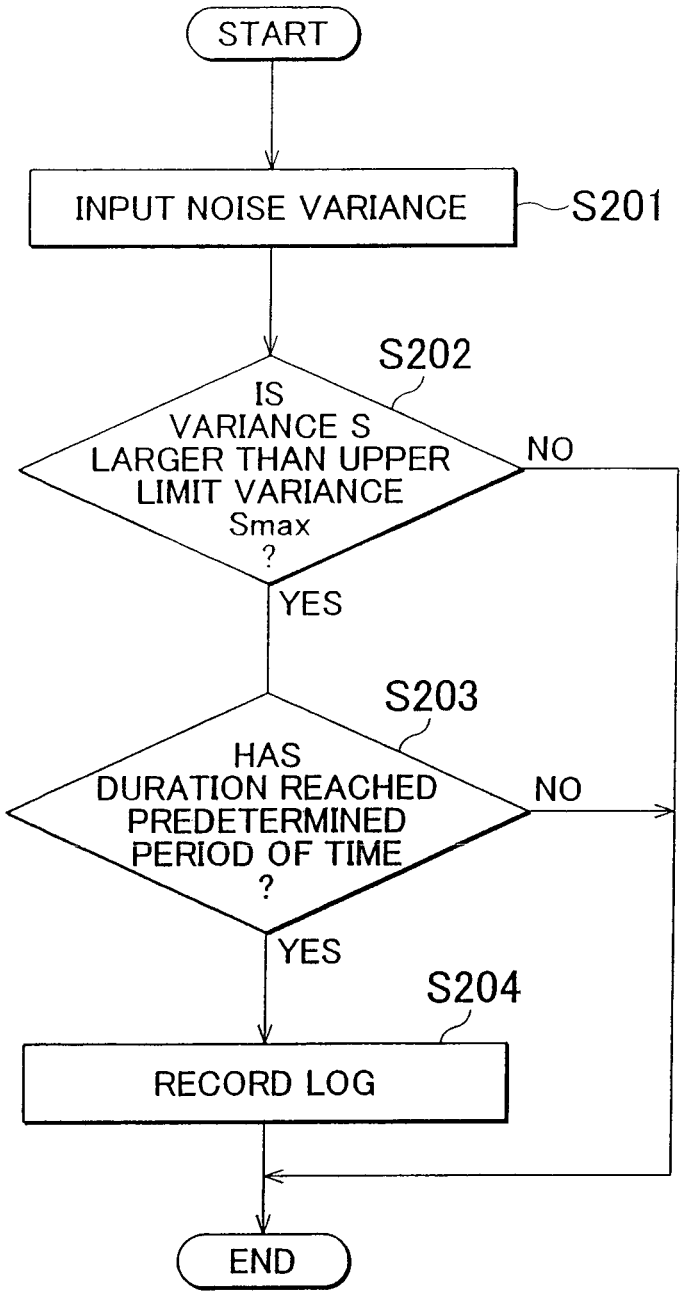
FIG. 7 is a flowchart that shows the process flow executed in abnormality detecting means according to the second embodiment.

FIG. 7 shows the process flow executed by the abnormality detecting means 25. In this process, when the noise variance 17, that is, the variance S in FIG. 3, is input to the abnormality detecting means 25 (S201), the abnormality detecting means 25 determines whether the variance S is larger than an upper limit variance Smax (S202). In S202, when it is determined that the variance S is not larger than the upper limit variance Smax (N), it is determined that there is no abnormality and then the process exits the routine. On the other hand, in S202, when it is determined that the variance S is larger than the upper limit variance Smax (Y), subsequently, the abnormality detecting means 25 determines whether the duration of this state, that is, the duration of the state that the variance S is larger than the upper limit variance Smax, has reached a predetermined period of time (S203). In S203, when it is determined that the duration has not reached the predetermined period of time (N), it is determined that there is no abnormality and then the process exits the routine. On the other hand, in S203, when it is determined that the duration has reached the predetermined period of time (Y), it is determined that an abnormality has occurred and then a log regarding this state is recorded (S204). Information, which will be recorded in this log, may be the variance S, a duration during which the variance S is larger than the upper limit variance Smax, time of occurrence, information that specifies a location of the web, at which an abnormality has occurred, and the like.

According to the present embodiment, by utilizing the high-frequency noise 16 (noise variance 17), it is possible to detect a faulty location of the web, a system abnormality, or the like, in addition to the function and advantageous effects according to the first embodiment.

The invention claimed is:

1. A web meandering correction system comprising:

an edge detector that detects a position of a widthwise edge of a web and outputs an edge position signal that indicates the position of the widthwise edge;

an HPF processing unit that executes a high-pass filtering process on the edge position signal using a predetermined lower limit frequency as a reference;

a high-frequency noise analyzing unit that analyzes high-frequency noise that has passed through the HPF processing unit;

an LPF processing unit that executes a low-pass filtering process on the edge position signal using a set upper limit frequency as a reference;

a coefficient setting unit that sets a coefficient that determines the characteristics of the low-pass filtering process, executed by the LPF processing unit, on the basis of a result of analysis performed by the high-frequency noise analyzing unit; and a meandering correction unit that executes a process for correcting meandering of the web on the basis of information acquired by the LPF processing unit, wherein the high-frequency noise analyzing unit includes a noise variance calculating unit that calculates a variance of the high-frequency noise, and wherein the coefficient setting unit includes an upper limit frequency setting unit that sets the upper limit frequency on the basis of the variance calculated by the noise variance calculating unit, such that the upper limit frequency is reduced as the variance increases and the upper limit frequency is increased as the variance reduces.

2. The web meandering correction system according to claim 1, further comprising an abnormality detecting unit that detects occurrence of an abnormality on the basis of the variance.

3. The web meandering correction system according to claim 2, wherein the abnormality detecting unit determines that an abnormality has occurred when the variance exceeds a predetermined upper limit value and when the duration of the state that the variance exceeds the predetermined upper limit value has reached a predetermined period of time.

4. The web meandering correction system according to claim 3, wherein, when the abnormality detecting unit determines that an abnormality has occurred, the abnormality detecting unit records a log that indicates a state that the abnormality has occurred.

5. A web meandering correction method comprising:

detecting a position of a widthwise edge of a web and outputting an edge position signal that indicates the position of the widthwise edge;

executing a high-pass filtering process on the edge position signal using a predetermined lower limit frequency as a reference;

analyzing high-frequency noise that has passed through the high-pass filtering process;

executing a low-pass filtering process on the edge position signal using a set upper limit frequency as a reference;

setting a coefficient that determines the characteristics of the low-pass filtering process on the basis of a result of analysis of the high-frequency noise; and correcting meandering of the web on the basis of information acquired through the low-pass filtering process, wherein the analysis of the high-frequency noise includes calculating a variance of the high-frequency noise, and wherein the upper limit frequency is set on the basis of the variance such that the upper limit frequency is reduced as the variance increases and the upper limit frequency is increased as the variance reduces.

6. The web meandering correction method according to claim 5, further comprising detecting occurrence of an abnormality on the basis of the variance.

7. The web meandering correction method according to claim 6, wherein the detection of occurrence of an abnormality includes determining that an abnormality has occurred when the variance exceeds a predetermined upper limit value and when the duration of the state that the variance exceeds the predetermined upper limit value has reached a predetermined period of time, and recording a log that indicates the state.

* * * * *